US005690544A

United States Patent [19]

Sakurai

[11] Patent Number: 5,690,544

[45] Date of Patent: Nov. 25, 1997

[54] WAFER POLISHING APPARATUS HAVING PHYSICAL CLEANING MEANS TO REMOVE PARTICLES FROM POLISHING PAD

[75] Inventor: Michio Sakurai, Tokyo, Japan

[73] Assignee: NEC Corporation, Tokyo, Japan

[21] Appl. No.: 623,936

[22] Filed: Mar. 28, 1996

[30] Foreign Application Priority Data

Mar. 31, 1995 [JP] Japan ..... 7-075719

[51] Int. Cl.[6] ..... B24B 21/18; B24B 33/00; B24B 47/26; B24B 55/00

[52] U.S. Cl. ..... 451/444; 451/541; 451/536

[58] Field of Search ..... 451/444, 541, 451/536, 420, 64, 66, 56; 15/24, 302, 308

[56] References Cited

U.S. PATENT DOCUMENTS

| | | | |
|---|---|---|---|
| 3,915,739 | 10/1975 | Maahs et al. | 134/21 |
| 4,680,893 | 7/1987 | Cronkhite et al. | 451/67 |
| 5,076,303 | 12/1991 | McBrady et al. | 15/308 |
| 5,154,021 | 10/1992 | Bombardier et al. | 451/444 |
| 5,245,796 | 9/1993 | Miller et al. | 451/41 |
| 5,351,360 | 10/1994 | Suzuki et al. | 15/308 |
| 5,456,627 | 10/1995 | Jackson et al. | 451/56 |
| 5,486,131 | 1/1996 | Cesna et al. | 451/56 |
| 5,531,861 | 7/1996 | Yu et al. | 156/636.1 |

FOREIGN PATENT DOCUMENTS

| | | | |
|---|---|---|---|
| 404035870 | 2/1992 | Japan | 451/444 |

*Primary Examiner*—James G. Smith
*Assistant Examiner*—Derris H. Banks
*Attorney, Agent, or Firm*—Foley, Hoag & Eliot LLP

[57] ABSTRACT

The invention relates to an apparatus for polishing wafers in the fabrication of semiconductor integrated circuits. The apparatus has a turntable on which a polishing pad of polyurethane foam is placed. The pad has a multiplicity of cavities in the polishing surface. In periodically dressing the pad, abrasive grains of diamond fall off the dressing tool, and some of the fallen abrasive grains remain in the cavities in the pad surface even though the pad surface is washed by water. According to the invention the polishing apparatus includes a cleaning device to drive abrasive grains out of the cavities. The cleaning device has a cylindrical body which rotates above the polishing pad. In an embodiment the cleaning device is a rotary brush having a multiplicity of needle-like parts of a synthetic resin on the cylindrical outer surface. The needle-like parts intrude into the cavities in the pad surface and flip abrasive grains out of the cavities. In another embodiment the cleaning device has an elastic covering on the cylindrical body. The elastic covering is squeezed into the cavities to temporarily close the opening of the cavities and reduce the air pressure in the cavities. When the elastic covering leaves the cavities a rush of the air into the cavities drives diamond grains out of the cavities.

8 Claims, 2 Drawing Sheets

WAFER POLISHING APPARATUS HAVING PHYSICAL CLEANING MEANS TO REMOVE PARTICLES FROM POLISHING PAD

BACKGROUND OF THE INVENTION

This invention relates to an apparatus for polishing wafers in the fabrication of semiconductor integrated circuits by using a polishing pad having a multiplicity of tiny cavities in the polishing surface. The apparatus according to the invention includes a physical cleaning means to drive particles of foreign matter such as diamond abrasive grains out of the cavities in the polishing pad surface prior to the wafer polishing operation, In the fabrication of semiconductor integrated circuits on a silicon wafer, several conductive layers and dielectric oxide layers are deposited and etched successively one on top of the other. As a result, rises or high regions and gaps or low regions develope on the wafer surface. At certain stages it becomes necessary to smooth the surface of the last deposited oxide layer in preparation for the deposition of another conducting layer. For this purpose, a recently developed wafer surface smoothing method is a so-called chemical mechanical polishing method using a polishing liquid and a polishing pad made of a relatively hard polyurethane foam. The polishing surface of the pad is a ground surface and hence is studded with a multiplicity of open cavities which were originally pores in the polyurethane foam. The polishing pad is placed on a turntable, and the wafers are gently pressed against the polishing pad and rotated relative to the pad.

It is necessary to periodrically dress the surface of the polishing pad on the turntable by using a grinding tool having an abrasive layer in which abrasive grains of diamond are embedded. In the dressing operation some of the diamond abrasive grains fall off the abrasive layer of the tool. In order to wash the fallen diamond grains out of the polishing pad surface, pure water is injected against the pad surface. However, some of the fallen abrasive grains enter and remain in the cavities in the pad surface. If the wafers are polished while the abrasive grains remain in some cavities in the polishing pad surface, it is likely that the polished wafer surface receives deep scratches which cause critcal damage to the integrated circuits or circuit elements fabricated on the wafers.

SUMMARY OF THE INVENTION

It is an object of the present invention to provide an improved wafer polishing apparatus which uses a polishing pad of the above described type and includes a cleaning means to remove abrasive grains, or particles of any other foreign matter, from the cavities in the polishing pad surface.

The invention relates to a wafer pollishing apparatus having a turntable, a polishing pad which is held on the turntable and has a multiplicity of tiny cavities in the polishing surface and a wafer holding means for holding each wafer parallel to the polishing pad and bringing the wafer into rubbing contact with the polishing surface of the polishing pad. According to the invention, the polishing apparatus includes a cleaning device comprising a physical cleaning means for driving particles of foreign matter such as abrasive grains out of the cavities in the polishing pad surface and a washing means for washing the particles out of the polishing pad surface by water.

In a preferred embodiment of the invention the physical cleaning means is a cylindrical rotary cleaner having a cylindrical cleaning element which is formed of a synthetic resin and has a multiplicity of needle-like parts standing on the cylindrical outer surface. That is, the rotary cleaner is a sort of rotary brush. The needle-like parts are thin relative to the cavities in the polishing pad surface. The rotary cleaner is rotated with its longitudinal center axis above and parallel to the polishing pad such that the needle-like parts are pressed against the polishing pad surface and forced into the cavities in the pad surface. Abrasive grains possibly existing in the cavities are flipped out of the cavities by the needle-like parts of the rotating cleaning element. Then the abrasive grains in question are washed out of the pad surface by pure water injected from nozzles of the washing means.

In another embodiment, the physical cleaning means is a cylindrical rotary cleaner having a cylindrical and elastic covering on the cylindrical outer side. The rotary cleaner is rotated with its longitudinal center axis above and parallel to the polishing pad surface such that the elastic covering is pressed against the polishing pad and squeezed into the cavities in the pad surface. Therefore, a certain volume of air is forced out of the cavities, and the opening of the cavities is watertightly closed by the elastic covering. In the thus closed cavities the pressure becomes below the atmospheric pressure. As the elastic covering of the rotating cleaner leaves the cavities, the air rushes into the cavities with the effect of driving abrasive grains out of the cavities.

With a wafer polishing apparatus according to the invention, it is possible to completely remove abrasive grains or any other particles from the cavities in the polishing pad surface and from the pad surface prior to the wafer polishing operation. Therefore, in the wafer polishing operation the wafer surfaces never receive scratches.

DESCRIPTION OF THE PREFERRED EMBODIMENTS

Figure 4:
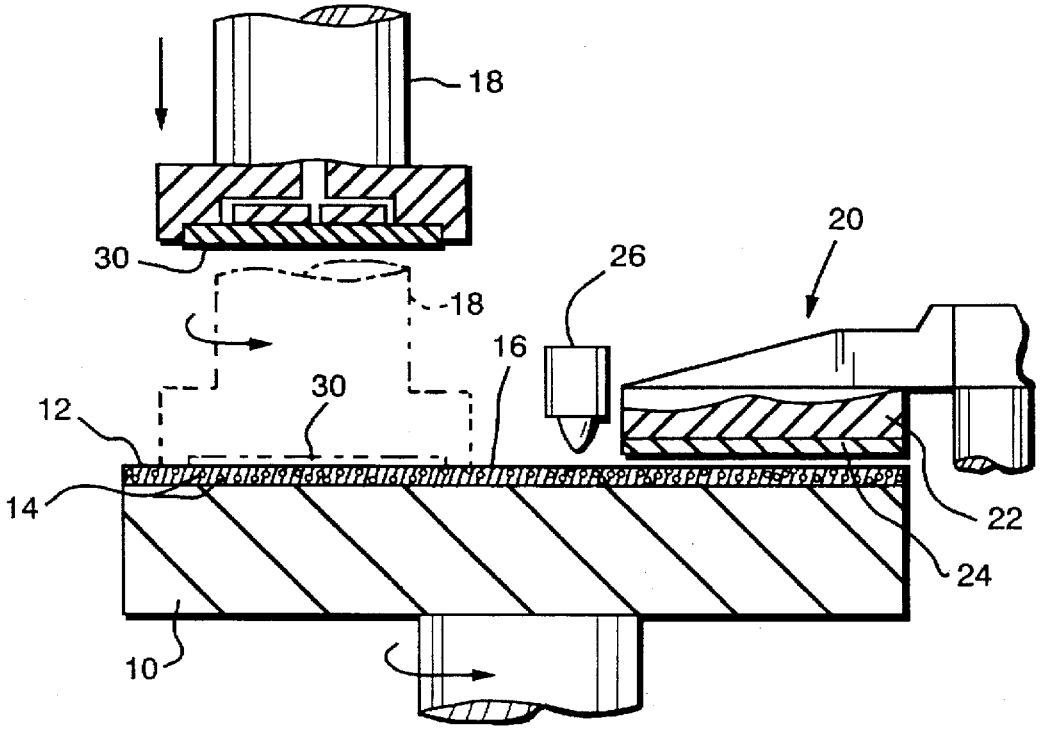
FIG. 4 (PRIOR ART)
FIG. 4 is an elevational sectional view of a principal part of a conventional wafer polishing apparatus to which the invention is applicable.

FIG. 4 shows a conventional wafer polishing machine having a turntable 10 on which a polishing pad 12 is sticked. The pad 12 is detachable for replacement. Above the polishing pad 12, a wafer holder 18 using a vacuum chuck holds a wafer 30 parallel to the pad 12. The wafer holder 18 is vertically movable to press the wafer 30 against the polishing pad 12 under suitable pressure (e.g., about 7 psi) and can rotate the wafer 30 relative to the rotating pad 12. Usually the polishing pad 12 is a sheet of relatively hard polyurethane foam. On the surface of the pad 12, pores 14 of the polyurethane foam become open cavities 16 of various sizes. For periodic dressing of the surface of the polishing pad 12, the polishing machine is provided with a grinding tool 20 having a rotatable head 22 laid with an electrodeposited abrasive layer 24 in which abrasive grains of diamond are embedded. Besides, there are water injection nozzles represented by a nozzle 26.

In dressing the surface of the polishing pad 12 in advance of the wafer polishing operation, the turntable 10 is rotated at a constant rate (e.g., 30 RPM), while a polishing liquid is dripped onto the polishing pad 12 (e.g., at a rate of 200 ml/min) from an unillustrated nozzle. Then the head 22 of the grinding tool 20 is positioned above the pad 12, and the abrasive layer 24 is pressed against the pad 12 under suitable pressure such as 1 psi. From the nozzles 28 pure water is injected onto the pad 12 (e.g., at a rate of 200 ml/min) to wash away chips issued from the abraded pad 12. During the dressing operation a portion of the diamond abrasive grains falls off the abrasive layer 24 of the tool 20. Most of the fallen diamond grains are washed away by the pure water injected from the nozzles 28, but some of the diamond grains enter and remain in the cavities 18 in the surface of the pad 12.

Figure 1:
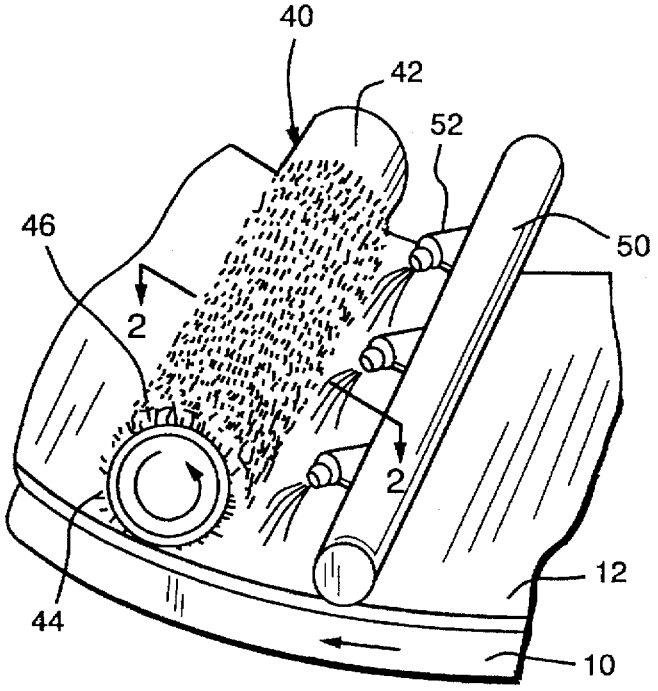
FIG. 1 shows, in a perspective view, a first embodiment of the cleaning device according to the invention.

FIG. 1 shows a first embodiment of the cleaning device according to the invention. The cleaning device is provided to the polishing machine of FIG. 4. The principal component of the cleaning device is a cylindrical rotary cleaner 40 consisting of a cylindrical shaft 42, which rotates about its longitudinal axis, and a tubular cleaning element 44 which tightly covers the shaft 42 and has a multiplicity of needle-like parts 46 standing on the cylindrical outer surface. The rotary cleaner 40 can be regarded as a rotary brush. The shaft 42 is made of a suitable metal such as, for example, stainless steel. The tubular cleaning element 44, inclusive of the needle-like parts 46, is a molding of a synthetic resin such as, for example, nylon resin. The needle-like parts 46 are resilient. The cleaning element 44 can be produced by a transfer molding method and can be detached from the shaft 42 for replacement.

The rotary cleaner 40 is arranged above the polishing pad 12 on the turntable 10 such that the needle-like parts 46 are pressed against the surface of the pad 12. The longitudinal axis of the shaft 42 is parallel to the pad 12 and extends along a radius of the turntable 10. It is necessary that the needle-like parts 46 can easily intrude into the cavities 16 in the surface of the pad 12. Therefore, the diameter of the needle-like parts 46 is made far smaller than the diameters of the pores 14 of the pad 12 and in most cases is about 100 μm or smaller.

The cleaning device includes a water feed pipe 50 having water injection nozzles 52 for injecting pure water onto the surface of the polishing pad 12. The pipe 50 is positioned at a short distance from the rotary cleaner 40, and the nozzles 52 are directed such that the injected water flows radially outward of the turntable 10.

Figure 2A:
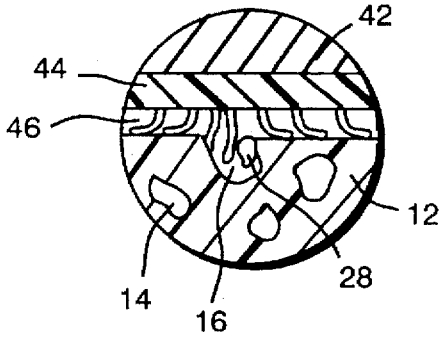
FIGS. 2(A) and 2(B) illustrate, in enlarged sectional views taken along the line 2—2 in FIG. 1, the function of the cleaning device of FIG. 1.
Figure 2B:
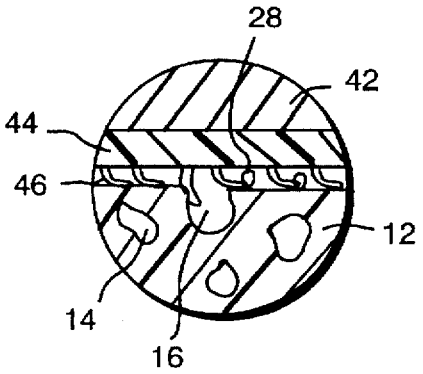

When the dressing operation is performed as described with reference to FIG. 4, the cleaning device of FIG. 1 is operated simultaneously. Diamond abrasive grains on the surface of the polishing pad 12 are washed away by pure water injected from the nozzle(s) 26 in FIG. 4 and the nozzles 52 in FIG. 1. Diamond grains fallen into relatively shallow cavities in the pad surface are also expelled by the injected water. The direction of the nozzles 52 is favorable for driving the diamond grains out of the pad 12. Referring to FIGS. 2(A) and 2(B), diamond grains 28 remaining in relatively deep cavities 16 (some of which are relatively narrow in opening area) are flipped out of the cavities 16 by the needle-like parts 48 of the rotating cleaner 40, and the diamnond grains 28 in question are washed away by the injected water. The rotary cleaner 40 is pressed against the pad 12 under a pressure of about 100 g/cm$^2$ and is rotated at a rate of 100 RPM or lower.

After the termination of the dressing operation, the injection of pure water and the operation of the rotary cleaner 40 are continued for a predetermined suitable period of time. It is optional to check whether diamond grains remain on the pad surface or in the cavities by irradiating the pad surface with infrared rays. If diamond exists, it will emit light by fluorescence.

Figure 3A:
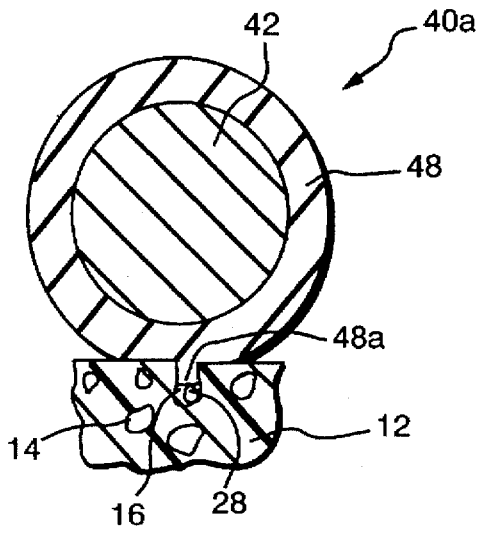
FIGS. 3(A) and 3(B) show, in enlarged cross-sectional views, the construction and function of a second embodiment of the cleaning device according to the invention.
Figure 3B:
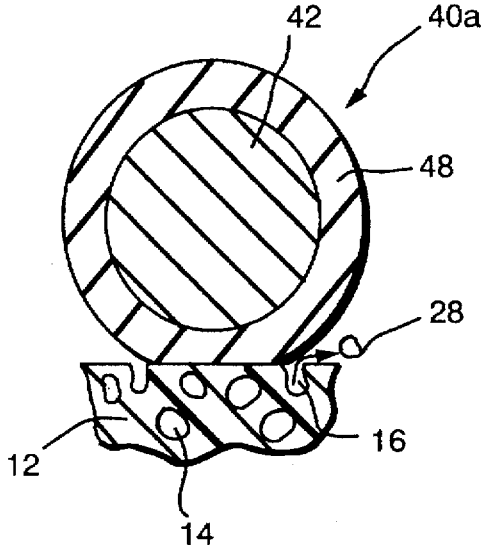

FIGS. 3(A) and 3(B) illustrate a second embodiment of the cleaning device according to the invention. This embodiment employs a cylindrical rotary cleaner 40A which consists of a cylindrical shaft 42 and a tubular and elastic covering 48. For example, the covering 48 is formed of a synthetic rubber. This is the sole difference of the second embodiment from the first embodiment shown in FIG. 1.

The rotating cleaner 40A is pressed against the polishing pad 12 under a pressure of at least 1 kg/cm$^2$ (which depends on the hardness of the elastic covering 48) so that the elastic covering 48 is locally squeezed on the pad surface. As illustrated in FIG. 3(A), a bulge 48*a* of the squeezed covering 48 intrudes into a cavity 16 in the pad surface whereby a certain volume of air is forced out of this cavity 16, and the opening of the cavity is watertightly closed by the covering 48. In the thus closed cavity 16 the pressure becomes below the atmospheric pressure. Referring to FIG. 3(B), as the cleaner 40A and the turntable 10 are rotated, the closed cavity reverts to an open cavity 16 which instantly resumes the atmospheric pressure. If a diamond grain 28 exists in the cavity 16 in question, the diamond grain is driven out of the cavity by a rush of the air into the cavity. Then the diamond grain 28 is washed away by pure water injected from the nozzles 52 shown in FIG. 1.

To augment the diamond grain driving force by increasing the volumes of air-pockets produced by closing the cavities 16 in the pad surface with the elastic covering 48 of the cleaner 40, it is optional to form a multiplicity of tiny cavities in the cylindrical surface of the covering 48. This is accomplished, for example, by wrapping a polyurethane foam sheet, which is lower in hardness than the polishing pad 12, around the cleaner 40A.

What is claimed is:

1. An apparatus for polishing wafers used as substrates of semiconductor integrated circuits, comprising:

a turntable;

a polishing pad which is held on the turntable and has a multiplicity of tiny cavities in the polishing surface;

a wafer holding means for holding each wafer parallel to the polishing pad and brining the wafer into rubbing contact with the polishing surface of the polishing pad; and a cleaning device which comprises a physical cleaning means for driving particles of foreign matter out of the cavities in the polishing pad surface and a washing means for washing said particles out of the polishing pad surface by water, wherein said physical cleaning means comprises a cylindrical rotary cleaner comprising a cylindrical cleaning element which is formed of a synthetic resin and has a multiplicity of needle-like parts standing on the cylindrical outer surface, said needle-like parts being thin relative to the cavities in the polishing pad surface, the rotary cleaner being rotated with its longitudinal center axis above and parallel to the polishing pad such that said needle-like parts are pressed against the polishing pad surface and forced into the cavities in the polishing pad surface.

2. An apparatus according to claim 1, wherein said cylindrical rotary cleaner extends along a radius of the turntable.

3. An apparatus according to claim 1, wherein said washing means comprises a plurality of nozzles for injecting water onto the polishing pad surface, said nozzles being directed such that the injected water flows radially outward of the polishing pad.

4. An apparatus for polishing wafers used as substrates of semiconductor integrated circuits, comprising:

a turntable;

a polishing pad which is held on the turntable and has a multiplicity of tiny cavities in the polishing surface;

a wafer holding means for holding each wafer parallel to the polishing pad and bringing the wafer into rubbing contact with the polishing surface of the polishing pad; and a cleaning device which comprises a physical cleaning means for driving particles of foreign matter out of the cavities in the polishing pad surface and a washing means for washing said particles out of the polishing pad surface by water, wherein said physical cleaning means comprises a cylindrical rotary cleaner comprising a cylindrical and elastic covering on the cylindrical outer side, the rotary cleaner being rotated with its longitudinal center axis above and parallel to the polishing pad surface such that said coveting is pressed against the polishing pad and squeezed into the cavities in the polishing pad surface to watertightly close the opening of the cavities and reduce the air pressure in the closed cavities and soon leaves the cavaties to allow the air to rush into the cavities.

5. An apparatus according to claim 4, wherein said cylindrical and elastic covering is formed of a synthetic rubber.

6. An apparatus according to claim 4, wherein said cylindrical and elasatic covering has a multiplicity of tiny cavities on the cylindrical outer surface.

7. An apparatus according to claim 4, wherein said cylindrical rotary cleaner extends along a radius of the turntable.

8. An apparatus according to claim 4, wherein said washing means comprises a plurality of nozzles for injecting water onto the polishing pad surface, said nozzles being directed such that the injected water flows radially outward of the polishing pad.

* * * * *